US005916741A

United States Patent [19]

Smith et al.

[11] Patent Number: 5,916,741

[45] **Date of Patent: *Jun. 29, 1999**

[54] PHOTOGRAPHIC ELEMENTS CONTAINING ELASTOMERIC MATTING AGENT

[75] Inventors: Dennis E. Smith, Rochester; Yongcai Wang, Penfield; Patrick M. Jeffries, Pittsford; James R. Bennett, Rochester, all of N.Y.

[73] Assignee: Eastman Kodak Company, Rochester, N.Y.

[ * ] Notice: This patent is subject to a terminal disclaimer.

[21] Appl. No.: 08/920,144

[22] Filed: May 26, 1997

[51] Int. Cl.[6] ..... G03C 1/76

[52] U.S. Cl. ..... 430/537; 430/536; 430/950; 430/961

[58] Field of Search ..... 430/950, 961, 430/537, 536

[56] References Cited

U.S. PATENT DOCUMENTS

| | | | |
|---|---|---|---|
| 2,932,629 | 4/1960 | Wiley | 260/91.5 |
| 2,992,101 | 2/1961 | Jelley et al. | 430/950 |
| 3,767,448 | 10/1973 | Hutton | 430/950 |
| 4,094,848 | 6/1978 | Naito | 260/29.6 |
| 4,447,525 | 5/1984 | Vallarino et al. | 430/539 |
| 4,524,131 | 6/1985 | Himmelmann et al. | 430/539 |
| 4,855,219 | 8/1989 | Bagchi et al. | 430/961 |
| 5,279,934 | 1/1994 | Smith et al. | 430/539 |
| 5,288,598 | 2/1994 | Sterman et al. | 430/539 |
| 5,378,577 | 1/1995 | Smith et al. | 430/537 |
| 5,447,832 | 9/1995 | Wang et al. | 430/527 |
| 5,538,935 | 7/1996 | Hastreiter et al. | 430/961 |
| 5,695,919 | 12/1997 | Wang et al. | 430/537 |
| 5,709,986 | 1/1998 | Smith et al. | 430/537 |

*Primary Examiner*—Richard L. Schilling
*Attorney, Agent, or Firm*—Carl F. Ruoff

[57] ABSTRACT

The present invention provides a photographic element comprises a support, at least one hydrophilic light-sensitive layer, and a light-insensitive layer containing a binder and polymer matte particles having the formula:

$$(A)_x(B)_y(C)_z \qquad (I)$$

where A is a monofunctional ethylenically unsaturated monomer which forms a homopolymer with a Tg less than 20° C., B is a monofunctional ethylenically unsaturated monomer which forms a homopolymer with a Tg greater than 60° C., C is a monomer with two or more ethylenically unsaturated groups, x is about 10 to 95 mole %, y is less than 85 mole %, and z is about 5 to 90 mole %.

10 Claims, No Drawings

PHOTOGRAPHIC ELEMENTS CONTAINING ELASTOMERIC MATTING AGENT

FIELD OF THE INVENTION

This invention relates to silver halide photographic light-sensitive elements containing a matting agent.

BACKGROUND OF THE INVENTION

It is conventional to incorporate finely powdered grains or matting agents into the protective layer of a photographic element to increase the surface roughness to achieve the following: (1) reduce self-adhering of the material, (2) reduce sticking of the material to manufacturing and processing devices, (3) improve the antistatic properties of the material, and (4) improve the vacuum release of the material in contact exposure. The matting agents are commonly very small particles of organic or inorganic materials, such as silicone dioxide, magnesium oxide, titanium dioxide, calcium carbonate, poly(methyl methacrylate), poly (vinyltoluene), poly(methyl methacrylate-co-methacrylic acid), and so on.

This "matting" of the surface layer suffers, however, from various disadvantages. Matte particles on a photographic film can cause pressure sensitization marks on a neighboring film by being pressed against the neighboring film. This can produce a plus or minus density spot upon processing. Further, by being pressed against and moved across the neighboring film, a plus or minus density line can become visible upon processing. Pressure sensitization from matte particles can occur during film manufacturing, product shipping, or customer use and can occur before or after exposure. The quality of the image is degraded by pressure sensitization marks on the film.

In addition, matte beads tend to dust during manufacturing processes such as high speed finishing operations. The "dusted" matte beads gradually build-up on finishing equipment and become redeposited on the film surface as dirt. The dusted matte beads can also cause film surface scratches and processing defects, thus resulting in product waste. In automatic film changers the dusted matte beads build-up in suction cup or driven roll areas causing film transportation difficulties.

Therefore, a foremost object of the present invention is to provide a silver halide photographic material which exhibits excellent resistance to both pressure sensitization marks in abraded areas and matte dusting during film manufacturing and transport processes.

SUMMARY OF THE INVENTION

In accordance with the present invention, a photographic element comprises a support, at least one hydrophilic light-sensitive layer, and a light-insensitive layer containing a binder and polymer matte particles having the formula:

$$(A)_x(B)_y(C)_z \quad \text{(I)}$$

where A is a monofunctional ethylenically unsaturated monomer which forms a homopolymer with a Tg less than 20° C., B is a monofunctional ethylenically unsaturated monomer which forms a homopolymer with a Tg greater than 60° C., C is a monomer with two or more ethylenically unsaturated groups, x is about 10 to 95 mole %, y is less than 85 mole %, and z is about 5 to 90 mole %.

The matte particles in accordance with this invention are included in any light insensitive layer of the photographic element, but preferably are included in the top-most layer of a light-sensitive silver halide photographic element, in a separate layer over the top surface of the photographic element, or in a layer in close proximity to the top-most layer so that the matte particles protrude above the surface of the top-most or outer-most layer. The matte particles have a mean size of from 0.3 to 10 $\mu$m, preferably from 0.5 to 8 $\mu$m, and most preferably from 1 to 6 $\mu$m.

ADVANTAGEOUS EFFECT OF THE INVENTION

Photographic elements in accordance with this invention demonstrate reduced pressure sensitivity and dusting characteristics in transport and finishing operations.

DESCRIPTION OF THE PREFERRED EMBODIMENTS

Photographic elements according to this invention can differ widely in structure and composition. For example, they can vary greatly in regard to the types of the support, the numbers and compositions of the imaging forming layers, and the kinds of auxiliary layers that are included in the elements. In particular, the photographic elements can be still films, motion picture films, x-ray films, graphic arts films, paper prints or microfiche. They can be black-and-white elements, color elements adapted for use in a negative-positive process, or color elements adapted for use in a reversal process. Typical supports include cellulose nitrate film, cellulose acetate film, poly(vinyl acetal) film, polystyrene film including syndiotactic polystyrene film, poly (ethylene terephthalate) film, poly(ethylene naphthalate) film, polycarbonate film, glass, metal, paper, polymer-coated paper, and the like.

In accordance with the present invention, the matte particles have a composition given by formula I, in which A is a monofunctional ethylenically unsaturated monomer which forms a homopolymer with a Tg less than 20° C., B is a monofunctional ethylenically unsaturated monomer which forms a homopolymer with a Tg greater than 60° C., C is a monomer with two or more ethylenically unsaturated groups, x is about 10 to 95 mole % and preferably from 20 to 80 mole %, y is less than 85 mole % and preferably 5 to 85 mole % and most preferably 10 to 70 mole %, and z is about 5 to 90 mole % and preferably 10 to 70 mole %. By monofunctional ethylenically unsaturated monomer is meant a monmer having one ethylenically unsaturated group. The matting agent is preferably incorporated into the surface protective layer of a light sensitive material. However, as indicated above, the matting agent can be incorporated into any light insensitive layer in the light sensitive element. By surface protective layer is meant either the emulsion side surface protective layer, or the backing side surface protective layer, or both. However, it is particularly preferable to incorporate the matting agent in the outermost surface protective layer on either side. The matting agent of the present invention is employed at a coating weight coverage of 0.001 to 0.3 g/m$^2$, preferably from 0.002 to 0.2 g/m$^2$, and most preferably from 0.003 to 0.15 g/m$^2$.

Suitable ethylenically unsaturated monomers which form a homopolymer with a Tg less than 20° C. and which can be used as component A of the present invention may include, for example, the following monomers and their mixtures: 4-butyl styrene, 4-hexyl styrene, vinyl methyl ether, decyl methacrylate, dodecyl methacrylate, ethylhexyl methacrylate, hexadecyl methacrylate, octyl methacrylate, lauryl methacrylate, octadecyl methacrylate, nonyl acrylate, octyl acrylate, propyl acrylate, methyl acrylate, butyl acrylate, heptyl acrylate, ethyl acrylate, dodecyl acrylate, 2-hydroxyethyl acrylate, lauryl acrylate, isobutyl acrylate and cyclohexyl acrylate. Preferably monomer A is butyl acrylate, ethyl acrylate, methyl acrylate, ethylhexyl methacrylate and lauryl methacrylate. Most preferably monomer A is butyl acrylate and ethyl acrylate.

Suitable ethylenically unsaturated monomers which form a homopolymer with a Tg greater than 60° C. and which can be used as monomer B of the present invention include, for example, t-butyl acrylate, pentachlorophenyl acrylate, 2-cyanobutyl acrylate, 2-cyanoheptyl acrylate, ferrocenylethyl acrylate, ferrocenylmethyl acrylate, isobomyl acrylate, 4-methoxycarbonylphenyl acrylate, 3,5-dimethyl adamantyl acrylate, t-butyl acrylamide, isohexyl acryl amide, morpholyl acryl amide, adamantyl methacrylate, isobutyl methacrylate, t-butyl methacrylate, 2-chloroethyl methacrylate, 4-cyanophenyl methacrylate, ethyl methacrylate, isobornyl methacrylate, isopropyl methacrylate, 3,3-dimethyl-2-butyl methacrylate, methyl methacrylate, phenyl methacrylate, 4-t-butylphenyl methacrylate, t-butyl methacrylamide, methyl phenyl acrylate, acrylonitrile, methacrylonitrile, ethylvinyl benzene, styrene, vinyl toluene, chloromethyl styrene and 4-t-butyl styrene. Preferably monomer B is methyl methacrylate, ethyl methacrylate, styrene, ethylvinyl benzene and vinyl toluene.

Suitable ethylenically unsaturated monomers with two or more ethylenically unsaturated groups and which can be used as component C of the present invention are monomers having two or more ethylenically unsaturated groups, and may include, for example, the following monomers and their mixtures: esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate; dienes such as butadiene and isoprene; esters of saturated glycols or diols with unsaturated monocarboxylic acids, such as, ethylene glycol diacrylate, ethylene glycol dimethacrylate, triethylene glycol dimethacrylate, 1,4-butanediol dimethacrylate, 1,3-butanediol dimethacrylate, pentaerythritol tetraacrylate, trimethylol propane trimethacrylate and polyfunctional aromatic compounds such as divinylbenzene and the like. Preferably, monomer C includes ethylene glycol dimethacrylate, ethylene glycol diacrylate, 1,4-butanediol dimethylacrylate or divinylbenzene. Most preferably, monomer C is divinylbenzene.

As to divinylbenzene, although available as pure monomer for laboratory use, it is most commonly sold commercially as a mixture of divinylbenzene and ethylvinylbenzene, available, for instance, from Dow Chemical Company as DVB-55 (typical assay 55.8% divinylbenzene and 43.0% ethylvinylbenzene) or DVB-HP (typical assay 80.5% divinylbenzene and 18.3% ethylvinylbenzene).

The matte particles for use in accordance with this invention can be made by various well-known techniques in the art, such as, for example, crushing, grinding or pulverizing of polymer down to the desired size, emulsion polymerization, dispersion polymerization, suspension polymerization, solvent evaporation from polymer solution dispersed as droplets, and the like (see, for example, Arshady, R. in "Colloid & Polymer Science", 1992, No 270, pages 717–732; G. Odian in "Principles of Polymerization", 2nd Ed. Wiley(1981); and W. P.

Sorenson and T. W. Campbell in "Preparation Method of Polymer Chemistry", 2nd Ed, Wiley (1968)). A preferred method of preparing matte particles in accordance with this invention is by a limited coalescence technique where polyaddition polymerizable monomer or monomers are added to an aqueous medium containing a particulate suspending agent to form a discontinuous (oil droplet) phase in a continuous (water) phase. The mixture is subjected to shearing forces, by agitation, homogenization and the like to reduce the size of the droplets. After shearing is stopped an equilibrium is reached with respect to the size of the droplets as a result of the stabilizing action of the particulate suspending agent in coating the surface of the droplets and then polymerization is completed to form an aqueous suspension of polymer particles. This process is described in U.S. Pat. Nos. 2,932,629; 5,279,934 and 5,378,577 incorporated herein by reference.

Another preferred method of preparing matte particle of the present invention is described in U.S. Pat. No. 5,447,832 incorporated herein by reference.

The matte particle surface may include reactive functional groups which form covalent bonds with binders by intermolecular crosslinking or by reaction with a crosslinking agent (i.e. a hardener). Suitable reactive functional groups include: hydroxyl, carboxyl, chloromethyl, carbodiimide, epoxide, aziridine, vinyl sulfone, sulfinic acid, active methylene, amino, amide, allyl, and the like. There is no particular restriction on the amount of reactive groups present, but their concentrations are preferably in the range of from 0.5 to 10 weight %. The particle surface may be surrounded with a layer of colloidal inorganic particles as described in U.S. Pat. No. 5,288,598, or a layer of colloidal polymer latex particles which have affinity with suitable binder as described in U.S. Pat. No. 5,279,934, or a layer of gelatin as described in U.S. Pat. No. 4,855,219.

Processing removable mattes may be used in the practice of the invention to further enhance the resistance of the photographic element to ferrotyping and blocking. Such processing removable mattes include particles of, for example, copolymers of alkyl (meth)acrylates and methacrylic acid, or acrylic acid, or itaconic acid, copolymers of alkyl (meth)acrylates and maleic monoesters or monoamides, copolymers of styrene or vinyl toluene and a,b-unsaturated mono- or di-carboxylic acids, or dicarboxylic monoesters or monoamides, graft copolymers containing maleic anhydride or methacrylic acid, and dicarboxylic acid mono-ester of a cellulose derivative, such as phthalate and hexahydro phthalate of methyl cellulose, hydroxyethyl cellulose, or hydroxypropylomethyl cellulose. Such processing soluble mattes are described in further detail in U.S. Pat. No 2,992,101; 3,767,448; 4,094,848; 4,447,525; and 4,524,131; which are incorporated herein by reference.

Any suitable binder may be used in the light-insensitive layers in practice of the present invention, including hydrophilic colloids such as gelatin as well as hydrophobic polymer resin binders. While the actual amount of binder coated in order to achieve desirable surface physical properties will vary depending on the size and amount of the matte particles. The total binder is coated at greater than about 100 mg/m$^2$ to provide effective adhesion of the matte particles to the surface of the element. By light-insensitive layer is meant a non-image forming layer and includes protective overcoat layers, ultraviolet ray absorbing layers, interlayers and the like.

Useful resin binders include polyurethanes (e.g. Neorez R960 sold by ICI), cellulose acetates (e.g. cellulose diacetate, cellulose triacetate, cellulose acetate butyrate, cellulose acetate propionate), poly(methyl methacrylate), polyesters (e.g. Vitel R sold by Goodyear Tire & Rubber Co.), polyamides (e.g. Unirez sold by Union Camp, Vesamide sold by General Electric Co.), polycarbonates (e.g. Makrolon sold by Bayer Co., Lexan sold by General Electric Co.), polyvinyl acetate, coalesced layer as set forth in U.S. Pat. No. 5,366,855 and U.S. Application Ser. No. 08/221,432 filed Mar. 31, 1994, and the like.

Any suitable hydrophilic binder can be used in practice of the present invention. Gelatin is the most preferred hydrophilic binder. Other hydrophilic binders include both naturally occurring substances such as proteins, protein derivatives, cellulose derivatives (e.g. cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. For crosslinkable binder such as gelatin, the binder is preferably cross-linked so as to provide a high degree of cohesion and adhesion. Crosslinking agents or hardeners which may effectively be used in the coating compositions of the present invention include aldehydes, epoxy compounds, polyfunctional aziridines, vinyl sulfones, methoxyalkyl melamines, triazines, polyisocyanates, dioxane derivatives such as dihydroxydioxane, carbodiimides, chrome alum, zirconium sulfate, and the like.

Gelatin can be used together with other water dispersible polymers as binders in the practice of the present invention. The water dispersible polymers can be incorporated into either light sensitive or light-insensitive layers. Suitable water dispersible polymers include both synthetic and natural water dispersible polymers. Synthetic water dispersible polymers may contain a nonionic group, an anionic group, or a nonionic group and an anionic group in the molecular structure. The nonionic group may be, for example, an ether group, an ethylene oxide group, an amide group, or a hydroxyl group. The anionic group may be, for example, a sulfonic acid group or the salt thereof, a carboxylic acid group or the salt thereof, or a phosphoric acid group or the salt thereof. The natural water soluble polymer may include a nonionic group, an anionic group, or a nonionic group and an anionic group in the molecular structure. Preferably, the natural water dispersible polymer is a glucose polymer or a derivative thereof, more preferably, starch, glycogen, cellulose, or dextran, and most preferably, dextran or a derivative thereof. The water dispersible polymers may be incorporated into the photographic materials of the present invention in an amount of preferably at least 1%, preferably from 5 to 50%, and most preferably from 10 to 30% based on the amount of the whole coated amount of gelatin on the side having a layer containing the matte particle of the present invention.

Water dispersible polymers useful for the present invention include vinyl polymer latex particles prepared by such as emulsion polymerization process, water-borne polyurethane dispersions, water-borne epoxy dispersions, water-borne polyester dispersions, and the like. The mean size of the dispersed particles is within the range of from 0.01 to 0.5 $\mu$m, preferably from 0.02 to 0.2 $\mu$m.

The photographic element of the present invention can contain at least one electrically conductive layer, which can be either surface protective layer or a sub layer. The surface resistivity of at least one side of the support is preferably less than $1\times10^{12}$ Ω/square, more preferably less than $1\times10^{11}$ Ω/square at 25° C. and 20% relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,394,441; 4,418,141; 4,495,276; 4,542,095; 4,582,781; 4,610,955; 4,916,011; and 5,340,676.

Any lubricant can be used in the outermost layer of the present invention. Typical lubricants include (1) silicone based materials disclosed, for example, in U.S. Pat. Nos. 3,489,567; 3,080,317; 3,042,522; 4,004,927; and 4,047,958; and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc disclosed in U.S. Pat. Nos. 2,454,043; 2,732,305; 2,976,148; 3,206,311; 3,933,516; 2,588,765; 3,121,060; 3,502,473; 3,042,222; and 4,427,964; in British Patent Nos. 1,263,722; 1,198,387; 1,430,997; 1,466,304; 1,320,757; 1,320,565 and 1,320,756; and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethlyene), poly(trifluorochloroethylene), poly(vinylidene fluoride), poly(trifluorochloroethylene-co-vinyl chloride), poly(meth)acrylates or poly(meth)acrylamides containing perfluoroalkyl side groups, and the like. Lubricants useful in the present invention are described in further detail in Research Disclosure No. 308119, published Dec. 1989, page 1006.

The light-insensitive layer useful in the practice of the invention may optionally contain surface active agents, antistatic agents, charge control agents, ultraviolet absorbing agents, thickeners, silver halide particles, colloidal inorganic particles, magnetic recording particles, and various other additives. When silver halide particles are included they are there for purposes other than image formation, such as, to control gloss and haze.

The matte-containing layer useful in the practice of the invention can be applied by any of a number of well-known techniques, such as dip coating, rod coating, blade coating, air knife coating, gravure coating and reverse roll coating, extrusion coating, slide coating, curtain coating, and the like. After coating, the protective layer is generally dried by simple evaporation, which may be accelerated by known techniques such as convection heating. Known coating and drying methods are described in further detail in Research Disclosure No. 308119, Published Dec. 1989, pages 1007 to 1008.

The present invention is also directed to a single-use camera having incorporated therein a photographic element as described above. Single-use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic material is exposed in a similar manner as any photographic materials are exposed in cameras, and then the product is sent to the developer who removes the photographic material and develops it. Return of the product to the consumer does not normally occur.

Single-use cameras and their methods of manufacture and use are described in U.S. Pat. Nos. 4,801,957; 4,901,097; 4,866,459; 4,849,325; 4,751,536; 4,827,298; European Patent Applications 0 460 400; 0 533 785; 0 537 908; and 0 578 225; all of which are incorporated herein by reference.

The invention will be further illustrated by the following examples.

EXAMPLES

Matte Particles Used in the Example Coatings

Matte particles used in the example coatings are listed in Table 1 together with their chemical composition and mean particle size.

TABLE 1

| Matte | Matte Composition | Size(μm) |
|---|---|---|
| M-1 | Polymethyl methacrylate | 3.8 |
| M-2 | Poly(styrene-co-ethylvinylbenzene-co-divinylbenzene) (50/22.5/27.5) | 5.1 |
| M-3 | Poly(ethylvinylbenzene-co-divinylbenzene)(20/80) | 5.8 |
| M-4 | Poly(styrene-co-butylacrylate) (80/20) | 3.6 |
| M-5 | Poly(styrene-co-butyl acrylate-co-ethylvinylbenzene-co-divinylbenzene) (30/50/9/11) | 3.3 |
| M-6 | Poly(styrene-co-butyl acrylate-co-ethylvinylbenzene-co-divinylbenzene) (30/20/22.5/27.5) | 3.8 |
| M-7 | Poly(butyl acrylate-co-ethylvinylbenzene-co-divinylbenzene) (50/22.5/27.5) | 3.4 |

EXAMPLES 1 TO 5

Preparation of the Photographic Element

A series of photographic elements are prepared as follows: A 178 μm thick polyethylene terephthalate support that contains an adhesion promoting subbing layer comprising a terpolymer latex of acrylonitrile,vinylidene chloride, and acrylic acid and a gelatin subbing layer on both sides is coated with the following layers in sequence on both sides: an emulsion layer (Table 2), an interlayer (Table 3), and a different overcoat layer for each side (Table 4).

TABLE 2

| Composition of the emulsion layer | | |
|---|---|---|
| Gelatin | 2.53 | $g/m^2$ |
| AgBr particles (1.95 μm in diameter and 0.013 μm in thickness) | 1.64 | $g/m^2$ |
| 4-Hydroxy-6-methyl-1,3,3A,7-tetraazaindene, Na salt | 0.032 | $g/m^2$ |

TABLE 2-continued

| Composition of the emulsion layer | | |
|---|---|---|
| 4,5-Dihydroxy-m-benzenedisulfonic acid | 0.013 | $g/m^2$ |
| Maleic acid hydrazide | 0.00068 | $g/m^2$ |
| Sorbitol | 0.040 | $g/m^2$ |
| Glycerin | 0.040 | $g/m^2$ |
| Resorcinol | 0.067 | $g/m^2$ |
| 5-nitroindazole | 0.0019 | $g/m^2$ |
| 4-Hydroxy-6-methyl-2-methylmercapto-1,3,3A,7-tetraazaindene, Na salt | 0.0061 | $g/m^2$ |
| 2-mercapto-1,3-benzothiazole | 0.0045 | $g/m^2$ |

TABLE 3

| Composition of the interlayer | | |
|---|---|---|
| Gelatin | 0.35 | $g/m^2$ |
| Disodium carboxymethyl casein | 0.082 | $g/m^2$ |
| Polyacrylamide | 0.054 | $g/m^2$ |
| Resorcinol | 0.006 | $g/m^2$ |
| 5-nitroindazole | 0.0038 | $g/m^2$ |
| 4-Hydroxy-6-methyl-1,3,3A,7-tetrazaindene, Na salt | 0.049 | $g/m^2$ |
| Poly(acrylamide-co-2-(sulfo-1,1-dimethylethylacrylamide) (20/80) Na salt | 0.012 | $g/m^2$ |

TABLE 4

| Composition of the overcoat layer | Side 1 | | Side 2 | |
|---|---|---|---|---|
| Gelatin | 0.35 | $g/m^2$ | 0.35 | $g/m^2$ |
| Matte | 0.057 | $g/m^2$ | 0.057 | $g/m^2$ |
| Dow Corning Silicone DC200 | — | 0.0069 | | $g/m^2$ |
| Silicone/polyethylene glycol | 0.046 | $g/m^2$ | — | |
| Disodium carboxymethyl casein | 0.073 | $g/m^2$ | 0.073 | $g/m^2$ |
| Polyacrylamide | 0.054 | $g/m^2$ | 0.054 | $g/m^2$ |
| Ludox ® | 0.11 | $g/m^2$ | 0.11 | $g/m^2$ |
| Resorcinol | 0.0059 | $g/m^2$ | 0.0059 | $g/m^2$ |
| Lithium trifluoromethane sulfonate | 0.045 | $g/m^2$ | 0.045 | $g/m^2$ |
| Zonyl ® FSN | 0.024 | $g/m^2$ | 0.015 | $g/m^2$ |

All the above layers can optionally contain bis (vinylsulfonyl methyl)ether or chrome alum hardener, or saponin surfactant, or Olin 10G surfactant, or Tergitol surfactant, or Duponol ME surfactant.

Matte Dusting Evaluation

After conditioning film samples overnight at 25° C. (70° F.) and 50% RH, side 1 is treated using a Model #1503 Teledyne Taber Abrader equipped with CS-5 wool felt wheels. These mildly abrasive wheels gently dislodge (or break off) matte beads without abrading the surface of the film. Films are run for 100 cycles under a normal load of 185 grams with a single pair of wheels. Two replicates per sample are run. Quantification of film "dusting" is achieved using a Gould Model 200 Micro Topographer equipped with a 2 to 2.5 μm diamond stylus. Vertical and lateral magnifications are 5000 and 50–100 X, respectively. Twenty topographic traces in each of four areas of each sample are done. Measurements are taken in "treated" and "untreated" film regions and the matte dusting results are reported on a percentage of number loss basis. Dusting is rated according to the following scale: 1=less than or equal to 15% of matte beads are lost in the test, 2=greater than 15% and less than or equal to 30% of matte beads are lost in the test, 3=greater than 30% and less than or equal to 50% of matte beads are lost in the test, and 4=greater than 50% of matte beads are lost in the test.

Pressure Sensitive Evaluation

Three sheets of film are stacked. A 4.1 Kg weight with three 1.6 cm felt tipped legs is placed on the stack. The center sheet is pulled out of the stack without moving the outside sheets. The outside sheets are exposed to a silver density of 1.0 and processed in a standard X-ray process. The severity of the lines appearing under the legs of the weight on the ouside sheets caused from the matte beads on the center sheet being pressed into and moved across the outside sheets are rated on a scale from 0 (no lines) to 5 (very severe). Values of 3 or less are acceptable.

The testing results are reported in Table 5.

TABLE 5

| | Matte | Matte Dusting | Pressure Sensitivity |
|---|---|---|---|
| Example 1 (comparison) | M-1 | 4 | 2 |
| Example 2 (comparison) | M-2 | 2 | 4 |
| Example 3 (comparison) | M-3 | 1 | 5 |
| Example 4 (comparison) | M-4 | 4 | 2.5 |
| Example 5 (Invention) | M-5 | 3 | 1 |
| Example 6 (Invention) | M-6 | 2 | 2 |
| Example 7 (Invention) | M-7 | 2 | 1 |

The comparative mattes M-1 and M-4 without monomers with two or more ethylenically unsaturated groups dust very heavily. The comparitive mattes M-2 and M-3 without monomers which form homopolymers with a Tg less than 20° C. have unacceptable pressure sensitivity. Inventive mattes M-5, M-6 and M-7; however, unexpectedly have both lower dusting and acceptable pressure sensitivity.

The invention has been described in detail with particular reference to certain preferred embodiments thereof, but it will be understood that variations and modifications can be effected within the spirit and scope of the invention.

What is claimed is:

1. A photographic element comprising a support, at least one hydrophilic light-sensitive layer, and a light-insensitive layer containing a binder and polymer matte particles having the formula:

$$(A)_x(B)_y(C)_z \quad (I)$$

where A is a monofunctional ethylenically unsaturated monomer which forms a homopolymer with a Tg less than 20° C., B is a monofunctional ethylenically unsaturated monomer which forms a homopolymer with a Tg greater than 60° C., C is a monomer with two or more ethylenically unsaturated groups, x is about 10 to 95 mole %, y is less than 85 mole %, and z is about 5 to 90 mole % wherein the polymer matte particles have a mean size of from 1 to 10 $\mu$m.

2. The photographic element of claim 1 wherein x is from 20 to 80 mole % , y is from 5 to 85 mole % and z is from 10 to 70 mole %.

3. The photographic element of claim 1 wherein the light-insensitive layer is a protective overcoat layer.

4. The photographic element of claim 1 wherein monomer A comprises 4-butyl styrene, 4-hexyl styrene, vinyl methyl ether, decyl methacrylate, dodecyl methacrylate, ethylhexyl methacrylate, hexadecyl methacrylate, octyl methacrylate, lauryl methacrylate, octadecyl methacrylate, nonyl acrylate, octyl acrylate, propyl acrylate, methyl acrylate, butyl acrylate, heptyl acrylate, ethyl acrylate, dodecyl acrylate, 2-hydroxyethyl acrylate, lauryl acrylate, isobutyl acrylate and cyclohexyl acrylate.

5. The photographic element of claim 1 wherein monomer A comprises butyl acrylate, ethyl acrylate, methyl acrylate, ethylhexyl methacrylate and lauryl methacrylate.

6. The photographic element of claim 1 wherein monomer B comprises t-butyl acrylate, pentachlorophenyl acrylate, 2-cyanobutyl acrylate, 2-cyanoheptyl acrylate, ferrocenylethyl acrylate, ferrocenylmethyl acrylate, isobomyl acrylate, 4-methoxycarbonylphenyl acrylate, 3,5-dimethyl adamantyl acrylate, t-butyl acrylamide, isohexyl acryl amide, morpholyl acryl amide, adamantyl methacrylate, isobutyl methacrylate, t-butyl methacrylate, 2-chloroethyl methacrylate, 4-cyanophenyl methacrylate, ethyl methacrylate, isobomyl methacrylate, isopropyl methacrylate, 3,3-dimethyl-2-butyl methacrylate, methyl methacrylate, phenyl methacrylate, 4-t-butylphenyl methacrylate, t-butyl methacrylamide, methyl phenyl acrylate, acrylonitrile, methacrylonitrile, ethylvinyl benzene, styrene, vinyl toluene, chloromethyl styrene and 4-t-butyl styrene.

7. The photographic element of claim 1 wherein monomer B comprises methyl methacrylate, ethyl methacrylate, styrene, ethylvinyl benzene and vinyl toluene.

8. The photographic element of claim 1 wherein monomer C comprises esters of unsaturated monohydric alcohols with unsaturated monocarboxylic acids, dienes; esters of saturated glycols with unsaturated monocarboxylic acids, esters of saturated diols with unsaturated monocarboxylic acids, and polyfunctional aromatic compounds.

9. The photographic element of claim 1 wherein monomer C comprises ethylene glycol dimethacrylate, ethylene glycol diacrylate, 1,4-butanediol dimethylacrylate and divinylbenzene.

10. The photographic element of claim 1 wherein the binder comprises gelatin.

* * * * *

UNITED STATES PATENT AND TRADEMARK OFFICE

CERTIFICATE OF CORRECTION

PATENT NO. : 5,916,741

DATED : June 29, 1999

INVENTOR(S) : Dennis E. Smith, et al.

It is certified that error appears in the above-identified patent and that said Letters Patent is hereby corrected as shown below:

On the title page:

Column 1,line "[22]" "Filed May 26, 1997"
should read –Filed: August 26, 1997—

Column 10, line 26 (Claim 6) "isobomyl"
should read –isobornyl—

Column 10, line 32 (Claim 6) "isobomyl"
should read –isobornyl—

Signed and Sealed this

Sixteenth Day of May, 2000

*Attest:*

Q. TODD DICKINSON

*Attesting Officer*

*Director of Patents and Trademarks*